US005542154A

United States Patent [19]

Demuth et al.

[11] Patent Number: 5,542,154

[45] Date of Patent: Aug. 6, 1996

[54] CONNECTION BETWEEN A REVOLVING FLAT CAR AND A DRIVE BELT

[75] Inventors: Robert Demuth, Nurensdorf; Jurg Faas, Dinhard; Paul Cahannes, Embrach, all of Switzerland

[73] Assignee: Maschinenfabrik Rieter AG, Winterhur, Switzerland

[21] Appl. No.: 253,255

[22] Filed: Jun. 2, 1994

[30] Foreign Application Priority Data

Jun. 3, 1993 [CH] Switzerland ..... 01 650/93
Aug. 20, 1993 [CH] Switzerland ..... 02 488/93

[51] Int. Cl.[6] ..... D01G 15/24

[52] U.S. Cl. ..... 19/114; 19/113

[58] Field of Search ..... 2/312; 19/102, 19/113, 114; 24/300, 580, 456, 457, 481, 697.1; 198/699.1

[56] References Cited

U.S. PATENT DOCUMENTS

| | | | |
|---|---|---|---|
| 4,580,318 | 4/1986 | Varga | 19/102 |
| 4,827,573 | 5/1989 | Kuehl | 19/102 |
| 4,955,111 | 11/1990 | Jagst | 19/102 |
| 4,982,478 | 1/1991 | Stahli et al. | 19/102 |
| 4,987,647 | 1/1991 | von Gehlen | 19/111 |

FOREIGN PATENT DOCUMENTS

| | | |
|---|---|---|
| 0144184 | 6/1985 | European Pat. Off. . |
| 0567747 | 11/1993 | European Pat. Off. . |
| 3814412 | 11/1989 | Germany . |
| 3907396 | 3/1990 | Germany . |
| 3835776 | 4/1990 | Germany . |
| 870424 | 6/1961 | United Kingdom . |
| WO92/14873 | 9/1992 | WIPO . |

*Primary Examiner*—John J. Calvert
*Attorney, Agent, or Firm*—Greenblum & Bernstein P.L.C.

[57] ABSTRACT

Improved connection between a revolving flat card and a drive belt. A connection between a flat rod of a revolving flat card and a flexible drive belt for the flat rods, having a flexible connecting element formed integrally with the drive belt and the connecting element being received directly in a part of the flat rod, for forming a snap-on connection, with the drive belt being arranged on a side opposite of the flat rod and including a flexible projection, with the projection being adapted for a frictional engagement, in a clampable manner, with a respective receiving element located at the ends of the flat rod.

27 Claims, 4 Drawing Sheets

CONNECTION BETWEEN A REVOLVING FLAT CAR AND A DRIVE BELT

CROSS REFERENCE TO RELATED APPLICATIONS

This application claims the priority of Swiss Application No.01 650/93-6, filed Jun. 3, 1993, the disclosure of which is incorporated herein by reference in its entirety.

BACKGROUND OF THE INVENTION

1. Field of the Invention

The invention relates to a textile machine, such as a card machine and more specifically to revolving flat arrangements of a revolving flat card. The flat rod of a revolving flat card comprises, in any case, a clothing receiving part which must be connected to a drive apparatus. The flat rod may comprise end heads or caps which can be connected both with the clothing receiving part as well as with the drive apparatus.

2. Discussion of the Background of the Invention and Material Information

The invention provides, in a first aspect, a connecting system between a revolving flat rod of a revolving flat card and a flexible drive belt for the flat rods. Such a connecting system is known, for example, from prior art German Patent Publication DE-A-3907 396 and cognate U.S. Pat. No. 4,955,111. It is described and shown therein, particularly in FIG. 4 that the end of the flat head is provided with a continuous bore of the shape of a hollow cylinder and the drive belt is provided with noses or projections which engage in respective bores in the flat heads. In a further embodiment, the flat head is provided with teeth having gaps between the teeth, into which gaps the teeth of a double toothed belt engage. It is important for the flat rods which are situated between the flexible bow and the toothed belt that they are sufficiently guided thereby. In the zone of the deflection or reorientation, however, a deflection of the flexible bow is required, so that the flat rods do not fall down or disengage from the toothed belt. After the deflection or reorientation the flat rods are easily removable from the toothed belt as they lie or reside freely thereon.

The above-noted apparatus has the disadvantage that the flat rods have to be guided mechanically (by means specially provided for this purpose) during the deflection or reorientation and, partly, on the rising and falling path of the endless loop of movements of the revolving flat. This requires substantially increased expenditures.

Prior art German Patent Publication DE-A-3814 412 and cognate U.S. Pat. No. 4,987,647, in FIG. 8, disclose a connecting system for usage with a flat chain, wherein the end part of a fixing bolt is provided with a continuous slot, thus providing two webs or bridges. Every bridge is provided with an outwardly directed nose or projection. The bridges are elastic, so that the noses can snap into a slot in the flat head. The system requires a fixing element(the bolt) which has to be connected to the flat chain itself. This arrangement however does not provide any practical advantages over conventional systems (with a screw instead of a bolt) and has not been implemented commercially.

The invention provides, in a second aspect thereof, a flat rod which is formed as a hollow profile and is provided with separately formed end heads. Such a flat rod is described, for example, in prior art U.S. Pat. No. 4,827,573 and consists of a steel tube drawn through a profile mold. At either end of the flat rod massive head pieces are provided for attachment to a drive belt. Such head pieces are connected to the flat rod either by welding or with rivets or screws, so that they can be exchanged when they have become unusable owing to wear and tear.

It has been determined that the welded connection occasionally leads to tension or stress in the flat rod and that then it is necessary to exchange the whole flat rod. The same also applies for screw and rivet connections, i.e., the applied connecting force (rotation of the screw or pressure during riveting) within a certain tolerance range for all flat rods so as to prevent excessive tension or stress.

SUMMARY OF THE INVENTION

The present invention, in its first aspect, has the object or purpose of improving the above-mentioned prior art apparatus in such a way that the flat rods are guided in a very simple and efficient manner, particularly in the zone of the deflection or reorientation, and that nevertheless the flat rods are connected to the drive belt in a manner in which they are easily exchangeable. This object is achieved by a connecting system between a revolving flat rod of a revolving flat card and a flexible drive belt for the flat rods, wherein the flat rod is connected in a clampable manner with the drive belt. The clampable connection is preferably a snap-on connection.

The advantages of the present invention, in its first aspect, are particularly that no additional mechanical deflection guiding means are required and that a simple and practical connection of the flat rods with the drive belt is provided during operation. The flat rods can be easily removed from and exchanged on the drive belt. The solution, in accordance with the invention, is not only applicable to known flat rods with cuboid-shaped flat heads, but also, for example, to flat rods which are provided at their ends with rod-like slide bolts, e.g., in accordance with European Patent Publication No. EP-A-567747.

The present invention, in its second aspect, has the object or purpose of providing a connection between the flat rod and the head pieces which is easy and inexpensive to manufacture and which reduces unnecessary local tensions or stresses, between the head piece and a hollow flat rod, to a minimum. This object is achieved via a flat rod for a revolving flat card having a back part and a clothing receiving part, wherein the flat rod is formed as a hollow profile and includes head pieces attached in the hollow profile at the two ends thereof, wherein the head pieces are provided with at least one recess on either side towards the hollow profile, in which a zone of the wall of the hollow profile, which zone is directly opposite the recess, is pressed inwardly by means of bending deformation for the attachment of the head pieces to the hollow profile.

The present invention, in its second aspect, has the major advantage that the connection between the head piece and the hollow flat rod is manufactured in a very inexpensive manner and that it nevertheless provides a dimensionally stable and locally precise connection between the two noted parts. This type of connection is particularly advantageous when light metals such as aluminum or the like are used as hollow profiles for manufacturing the flat rods. Owing to the inexpensive production of such flat rods it is substantially more economical to exchange such flat rods in their entirety than to exchange only the head parts.

Specifically, one embodiment of this invention provides for a connection between a flat rod of a revolving flat card and a flexible drive belt for the flat rods, wherein a connecting element is formed, one of integrally with the drive belt and with a part of the flat rod, and is received in one of directly in a part of the flat rod and in the belt, for forming a snap-on connection.

In a further embodiment of this invention, the drive belt is provided, on the side opposite of the flat rod, with a projection, the projection being adapted for engagement, in a clampable manner, with a respective receiving element located at the ends of the flat rod.

In a variation of the previous embodiment, the receiving element consists of two slide bolts, the slide bolts projecting at the end of the flat rod, and the flat rod sliding thereon along a flexible bow of the flat card, with the projection of the drive belt engaging, in a clamping manner, between the two slide bolts.

In yet a further variation of the previous embodiment, the projection is provided with a slot, the slot extending in the longitudinal direction of the drive belt.

In another embodiment of this invention, the receiving element consists of two slide bolts projecting at the end of the flat rod upon which the flat rod slides along a flexible bow of the flat card, and wherein a slide bolt is clamped on one side by a projection of the drive belt.

In a different embodiment of this invention, the receiving element consists of two slide bolts projecting at the end of the flat rod on which the flat rod slides along the flexible bow of the flat card, and wherein a slide bolt is clamped on either side by one projection each of the drive belt.

In yet a further embodiment of this invention, the end of the flat rod is cuboid shaped, and wherein a pin, aligned towards the drive belt, is provided with a clamping element at the end that engages in a clamping manner in a respective receiving hole located in the drive belt. The clamping element preferably consists of at least one spring washer or of a rubber spring.

In still a further embodiment of this invention, the end of the flat rod is cuboid shaped, and wherein a projection is provided on the drive belt, the projection being encased in a clamping manner by a clamping element in a respective receiving hole located in the end of the flat rod. The clamping element preferably consists of two laterally arranged leaf springs.

A further major embodiment of this invention pertains to a drive belt for a revolving flat card, wherein a connecting element, for a connecting a flat rod by means of a snap-on connection, is formed integrally with the belt.

Another major embodiment of this invention pertains to a flat rod for a revolving flat card, wherein a connecting element, for connecting the rod with a belt by means of a snap-on connection, is formed integrally in a portion of the flat rod.

Yet an additional embodiment of this invention pertains to a flat rod for a revolving flat card having a back part and a clothing receiving part, wherein the flat rod is formed as a hollow profile and includes head pieces attached in the hollow profile at the two ends thereof, wherein the head pieces are provided with at least one recess on either side towards the hollow profile, in which a zone of the wall of the hollow profile, which zone is directly opposite the recess, is pressed inwardly by means of bending deformation for the attachment of the head pieces to the hollow profile. Preferably, the back part is of a substantially rectangular form and the ratio between the width of the receiving part and the minimum width of the back part is less than 3:1. Preferably yet, the ratio is in the range of about 2.5:1 to 1.5:1. In addition, the ratio between height of the flat rod and the width of the clothing receiving part is less than 2:1.

In a variation of the previous embodiment, the recess in the head pieces is at least partly rectangularly shaped.

In a further variation of the previous embodiment, a recess or a guiding means is provided on either side in the inner wall of the back part of the flat rod in a longitudinal direction.

In another variation of the previous embodiment, the recess or the guiding means extends over the whole length of the flat rod.

In an additional variation of the previous embodiment, the wall thickness of the wall of the hollow profile in the zone of the head part is thinner than the wall thickness of the wall of the hollow profile in the remaining area thereof.

An additional major embodiment of this invention pertains to a flat rod for a revolving flat card having a back part and a clothing receiving part wherein the flat rod is formed as a hollow profile and includes head pieces attached in the hollow profile at the two ends thereof, wherein the back part is of a substantially rectangular form and wherein the ratio between the width of the receiving part and the minimum width of the back part is less than 3:1. Preferably, the ratio is in the range of about 2.5:1 to 1.5:1.

In a variation of the previous embodiment, the ratio between maximum width of the back part is less than 3:2, and the hollow profile is drawn from a steel tube or is made of extruded aluminum.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
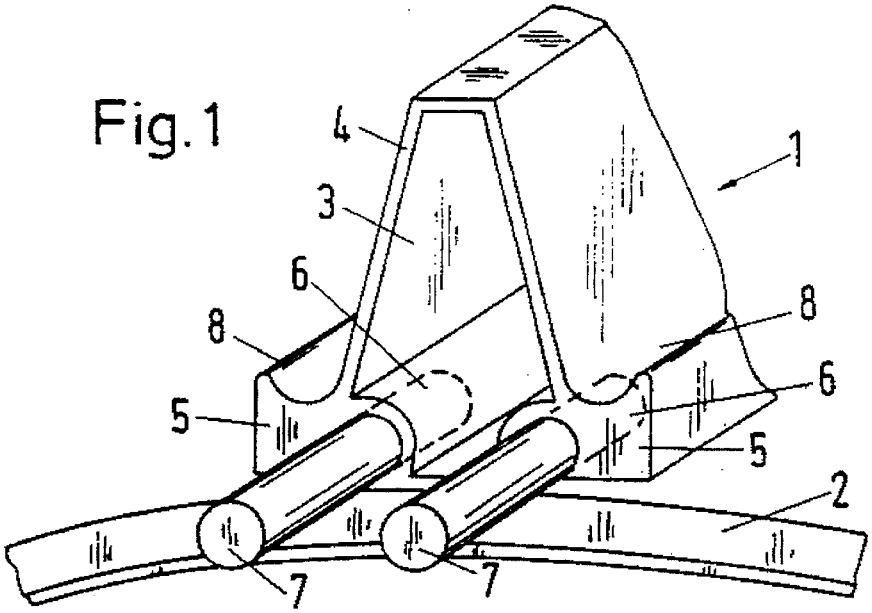
FIG. 1 shows a perspective representation of a part of a flat rod.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention, with the same reference numerals being used to the utmost extent for the same elements in the several drawing figures.

In terms of background, the specific details of a revolving flat card per se are fully disclosed in U.S. Pat. No. 4,982,478. Novel slide guides for the revolving flat are shown in European Patent Application No. EP 94810198.5 and copending cognate U.S. patent application Ser. No. 08/228,388, filed Apr. 15, 1994 and European Patent Application EP 94810194.4 and copending cognate U.S. patent application Ser. No. 08/228,387, filed Apr. 15, 1994 and can be utilized in conjunction with the structures of the present invention. For the sake of simplicity, however, the use of conventional and known slide guides is assumed in the description below, as they are also applicable to the invention.

The revolving flat set of a card, in accordance with German Patent Publication No. DE-A-3835776, comprises, for example, the utilization of 106 flat rods 1, whereof 41 are situated in the working position, i.e., they are in contact with the slide guide. FIG. 1 shows a perspective representation of a part of a flat rod 1 on a so-called flexible bow 2, which is used here as a slide guide. The flat rod 1 is provided with a hollow chamber 3 with a side wall 4. At its lower end, which extends towards the swift of the revolving flat card, the flat rod 1 is provided with two reinforcing ribs 5, in which connecting holes 6, having the form of pocket or blind holes, are provided. Slide bolts 7 are pressed or screwed into holes 6. Flat rod 1 uses these slide bolts 7 to run on flexible bow 2. The reinforcing ribs 5 are each provided with raised edge 8, so that the clothing (not shown) can be easily applied to flat rod 1 by way of edge-forming.

Figure 2:
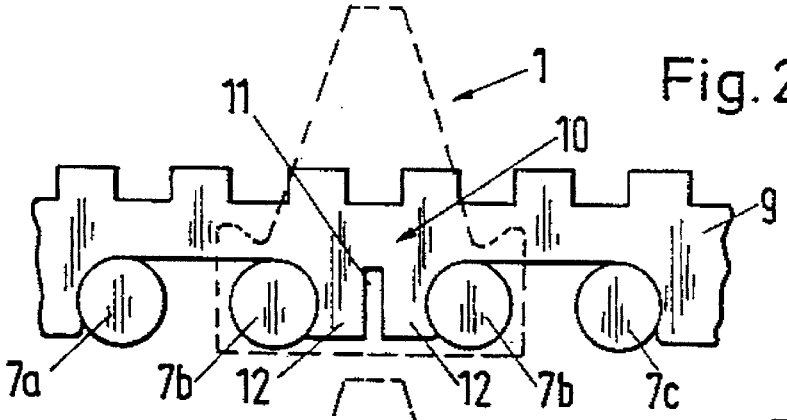
FIG. 2 shows a first embodiment of a connection between the flat rod of FIG. 1 and a first drive belt.

Flat rods 1 can be made to rotate, such as by drive belts (not shown in FIG. 1). FIGS. 2 to 5 show four successive embodiments of a connection between a drive belt 9 and slide bolt 7. In FIG. 2, the left bolt **7*a* belongs to or is associated with a first flat rod (not shown), the central two bolts 7*b* belong to a second flat rod 1 (indicated via a broken line) and the right bolt 7*c* belongs to a third flat rod (not shown). It should be understood that the distance between the bolts 7*b* is fixedly predetermined, i.e., it is not changeable, and that the distance, for example, between left bolt 7*a* and the right bolt 7*b* is changeable, depending on the partition of drive belt 9**. This distance is of no special importance for the connecting system per se.

Drive belt 9, which has a width of approximately 50 mm and a thickness of approximately 2.5 mm, is provided, in the zone of bolt **7*b*, with a downwardly projecting tooth-like projection 10. Projection 10 is provided in its lateral extension towards bolts 7*b* with the same curvature as that of bolts 7*b*. In the central zone of projection 10 a relief slot 11 is provided. As projection 10 is somewhat wider, in the lower zone, than the distance between bolts 7*b*, projection 10 is clamped in an immobile manner between two adjacent bolts 7*b*. Flat rod 1, however, can be removed from toothed belt 9 very easily, as two cams 12 of projection 10 are pressed against each other while flat rod 1 is pulled away. Similarly, slide bolts 7*b* are lightly pressed onto drive belt 9** during the application of the flat rod.

For this purpose, the edges of cams 12 facing towards bolts 7 are radiused, so that the projection 10 easily snaps into the intermediate space between the two bolts **7*b***.

Figure 3:
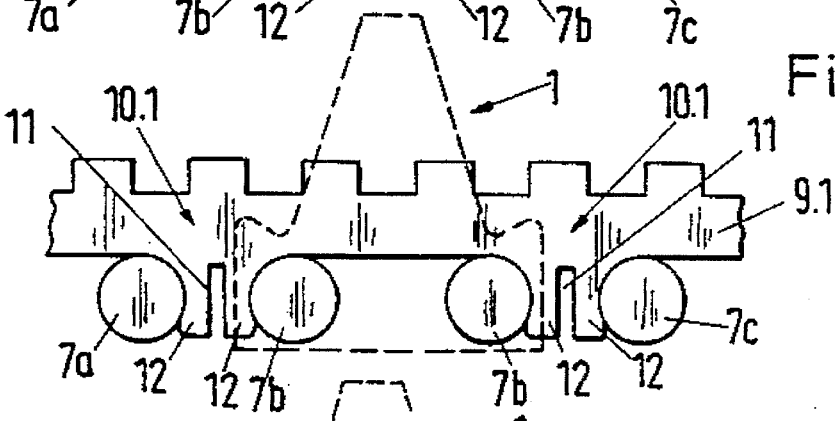
FIG. 3 shows a second embodiment of a connection between the flat rod of FIG. 1 and a second drive belt.

FIG. 3 shows a second embodiment of a drive or toothed belt 9.1 in connection with the flat rod in accordance with FIG. 1. Two teeth-like projections 10.1, which are arranged similarly to projection 10 in FIG. 2, encompass the two bolts **7*b* of flat rod 1. Therefore, an open intermediate space remains between the two bolts 7*b*, which space becomes slightly curved during the deflection on the toothed wheel (not shown). In this way the snap-on connection becomes somewhat looser, but remains sufficiently stable so as to keep flat rods 1 securely on toothed belt 9.1**.

Figure 4:
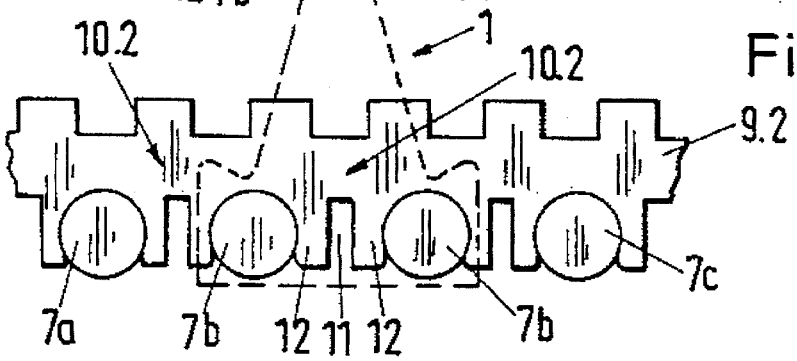
FIG. 4 shows a third embodiment of a connection between the flat rod of FIG. 1 with a third drive belt.

FIG. 4 shows a third embodiment of a drive or toothed belt 9.2. Here every bolt **7*b* is encompassed on both sides by a tooth-like projection 10.2. As in the first embodiment, in accordance with FIG. 2, the sides of projections 10.2 facing towards the bolts 7*b* are partly provided with the same curvature as bolts 7*b*. Therefore, two such projections 10.2 clamp bolt 7*b* of flat rod 1. Relief slots 11 are again provided between the cams 12 of projections 10.2, which slots are slightly wider in this case than in the FIG. 2 embodiment. As is shown in FIGS. 2 to 4, relief slots 11 have approximately the same depth as the height (or depth) of projections 10 or 10.1**, respectively.

Figure 5:
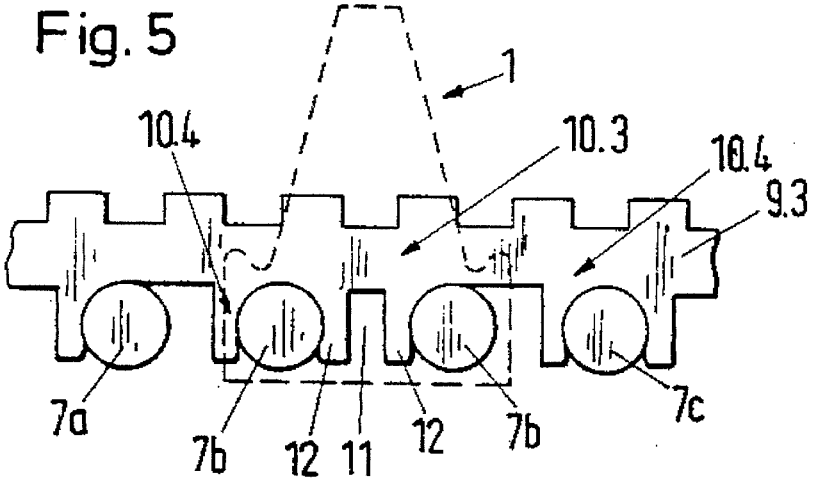
FIG. 5 shows a fourth embodiment of a connection between the flat rod of FIG. 1 and a fourth drive belt.

FIG. 5 shows a fourth embodiment of a connection between a drive belt 9.3 and bolt **7*b* of the flat rod 1. In this case, two different projection 10.3 and 10.4 are provided, which, on the one hand, engage between bolts 7*b* (projection 10.3) and, on the other hand, encompass only the right bolt 7*b* (projection 10.4**).

In the connection forms and embodiments shown in FIGS. 2 –5, the direction of movement of the drive belts 9, 9.1, 9.2 or 9.3 is not important since, during deflection, at least one of the bolts **7*b* of flat rod 1** remains permanently stably clamped by the toothed belt.

Figure 6:
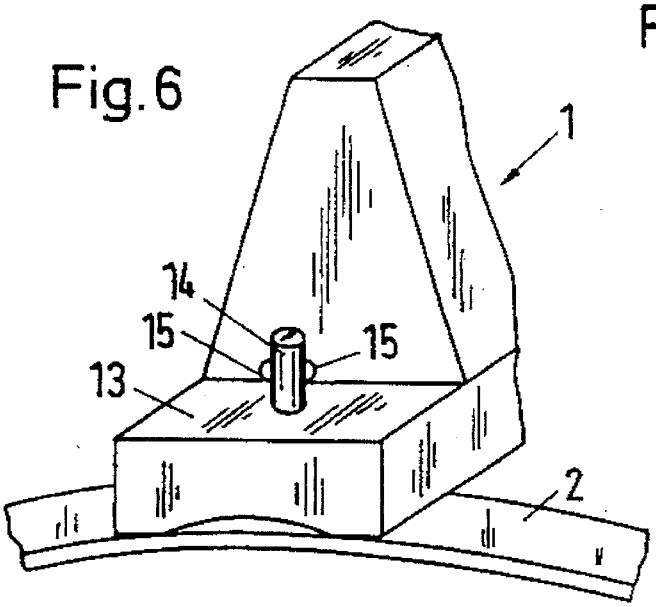
FIG. 6 shows a perspective representation of another embodiment of the flat rod and the connection of the flat rod with a further drive belt.
Figure 6A:
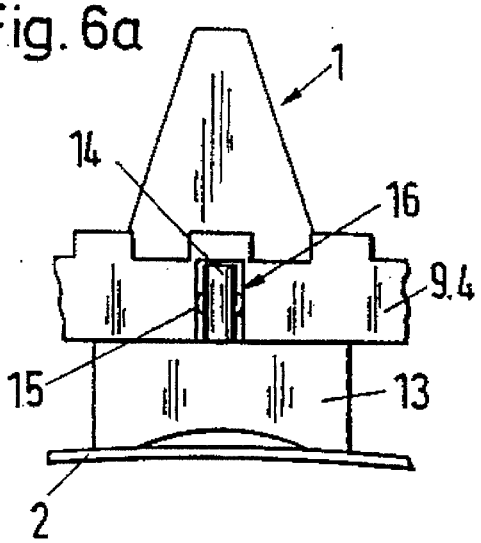
FIG. 6*a* shows a front view of the FIG. 6 embodiment.

FIGS. 6 and **6*a* show another embodiment of the clamping connection with a drive or toothed belt 9.4. Flat rod 1 is arranged in this embodiment not as a hollow profile, but as a massive rod and is provided in the usual form with a cuboid or parallelepiped end 13 on which a pin 14 is arranged in a centered manner. Pin 14 is provided with two outwardly bent leaf springs 15 which engage in a respective pocket-hole or blind bore 16 in drive belt 9.4 (FIG. 6*a*). The pocket-hole bore 16 may be reinforced accordingly by means of a metal bushing or the like. In order to achieve a further improvement of the snap-on connection it is also possible to provide respective slots or grooves in the metal bushing. In this way a clamping connection is also obtained between flat rod 1 and drive belt 9.4, which is nevertheless easy to release. It should be understood that, in an additional modification (not shown herein) leaf springs 15 could also be provided in a pocket-hole bore 16, so that pin 14 is clamped by leaf springs 15. In order to reinforce the clamping it is also possible to provide appropriate slots in pin 14. Alternatively, an annular groove may be milled into pin 14 or the picket-hole bore 16. Instead of leaf springs 15, elastic washers or a rubber spring, in the form of a rubber ring, could also be provided in a groove either in pin 14 or in pocket-hole bore 16**.

Figure 7:
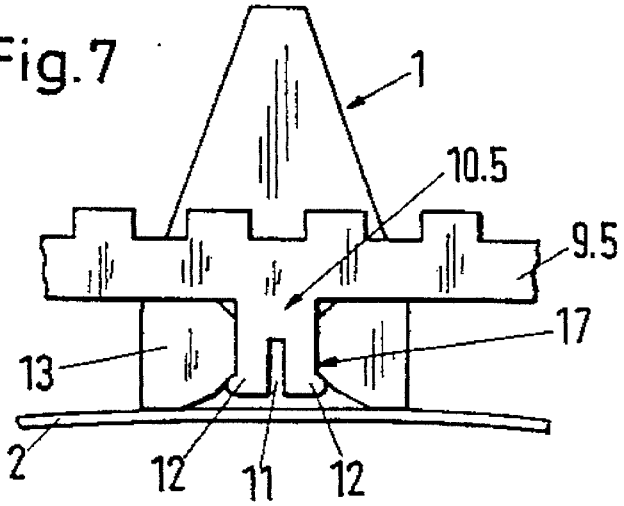
FIG. 7 shows a further embodiment of a connection between a flat rod and a drive belt.

FIG. 7 shows a further modification of the clamping or snap-on connection in accordance with FIGS. 6 and 6*a*. The cuboid end 13 of flat rod 1 is provided with a continuous or through bore 17 which is radiused or chamfered at top and bottom. Projection 10.5 is similar to the projections previously described with reference to FIGS. 1 to 5. Cams 12 are also radiused on the outwardly-extending edges so that secure "latching and unlatching" are ensured. Alternatively, only one pocket-hole bore could be provided in cuboid end 13, whereby the shown projection 10.5 is continuously subjected to an elastic tension in the clamped condition, i.e., cams 12 are pressed against one another at their ends and slot 11 is provided with a tapered configuration. It should also be understood that a man skilled in the art would immediately think of further possible clamping and snap-on connections owing to the illustrated examples without deviating from the scope and nature of the invention. In addition, projections 10 may be reinforced with glass fibers or the like so that they become every more durable.

Figure 8:
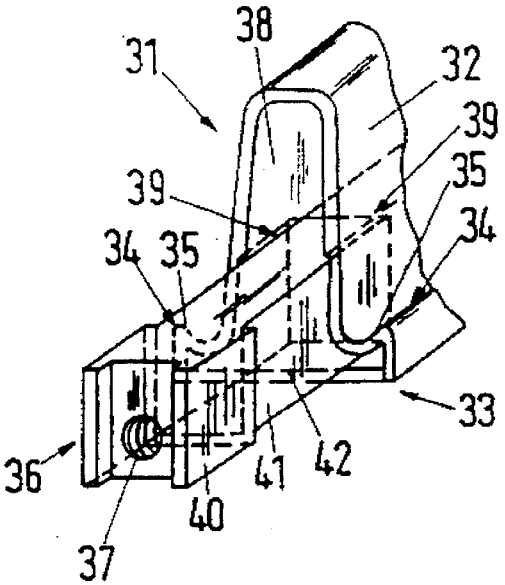
FIG. 8 shows a perspective view of a flat rod with a partly inserted head piece for attachment to a chain or belt drive.

FIG. 8 shows a flat rod 31 with a back part 32 and a clothing receiving part 33. Usually, a saw-tooth-like clothing (not illustrated) is clamped onto the clothing receiving part 33, for which purpose two lateral projections 34 are provided with inwardly-extending, inclined holding surfaces 35. Head pieces 36 are attached to the outer ends of flat rod 31, only one end of which is visible here. Head pieces 36 are also provided with a threaded bore 37 for the connection with a further coupling element (not illustrated) which in turn is coupled with the chain drive or the belt drive in a well known manner.

FIG. 8 further shows that recesses or guiding means 39, extending in the longitudinal direction of flat rod 31, are provided on the inner wall 38 of back part 32. Head piece 36 consists of a head part 40 and an insertion part 41. The insertion part 41 is arranged in such a manner that it is guided more or less free from play between recesses 39 and a floor zone 42 of clothing receiving part 33. The rectangular cross section of the insertion part 41 is smaller, due to a recess of several millimeters in the zone of the sides and the lower side, than the rectangular cross section of head part 40. This results in a kind of detents or shoulders so as to position head piece 36 precisely with respect to flat rod 31. Concerning further details on flat rods guided on a flexible bow of a card, reference can easily be made to the appropriate literature.

Figure 9:
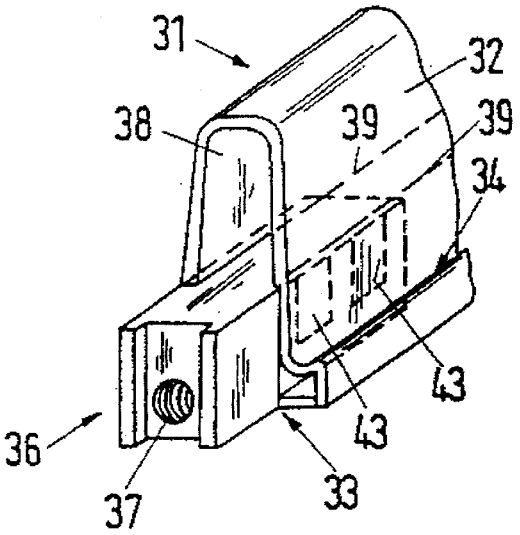
FIG. 9 shows a similar representation as that of FIG. 1, with the head piece now being fully inserted into the hollow flat rod.

FIG. 9 shows a head piece 36 in the inserted condition. At the same time, two rectangular recesses or grooves 43 are shown in broken lines, whose functions will be explained hereinafter, in closer detail, with reference to FIGS. 10 and 11.

Figure 10:
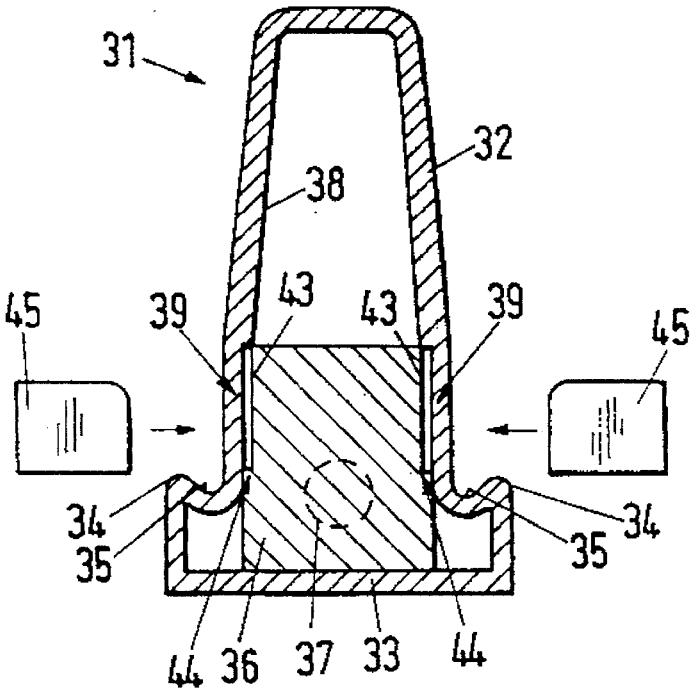
FIG. 10 shows a cross section through the flat rod and the head piece, in accordance with FIG. 1, before the forming via bending.

FIG. 10 shows a vertical cross section through a flat rod 31 and a head piece 36 in accordance with FIG. 8 and the recess or groove 43 shown in FIG. 9; this being before the actual connection between the insertion part 41 of head piece 36 and hollow flat rod 31. The rectangular recesses or guiding means 39 can be seen in the lower zone of back part 32, which recesses or guiding means correspond to the height of insertion part 41 as inserted into flat rod 31 (compare FIG. 8). These recesses or guide means 39 extend, as does the entire profile form, over the whole length of flat rod 31. Two rectangular recesses or grooves 43 are provided in insertion part 41 on either side, which grooves or recesses extend from the upper edge to about to the center of insertion part 41. Recesses or grooves 43 are provided with rectangular (sharp) edges 44 as are the lateral recesses of grooves 43.

Four laterally arranged dies 45 (of which only two are shown in FIG. 10) are provided so as to press the wall 38 of back part 32 in the zone of recesses 39 against the insertion part 41 (indicated by two opposed arrows). These dies 45 are pressed simultaneously by means of a pressing device (not shown here in close detail) into the predefined zones of the wall of flat rod 31, i.e., precisely opposite of the rectangular recesses or grooves 43, so that on both sides an even distribution of the pressing forces is made on wall 38 and on insertion part 41. The length of insertion part 41 is selected in such a way that a tilting of head piece 36 is prevented. The lower side of head piece 40 is used as the slide surface on the flexible bow of the card, and a turning moment is imparted on head piece 36 by the chain or belt drive.

Figure 11:
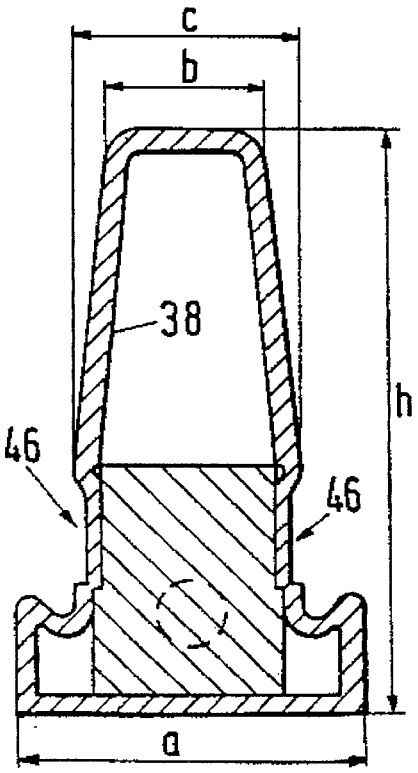
FIG. 11 shows a cross section through the flat rod in accordance with FIG. 12 and the head piece after the forming via bending.

This leads to a form-fitting connection 46, as is clearly shown in FIG. 11. Insertion part 41 is held by wall 38 which in the zone of the sharp edges 44 and the lateral sharp edges of grooves 43 has been pressed in by forming, bending or punching with dies 45. In this way insertion part 41 is guided, on the one hand, without play on the upper side through rectangular recesses or guiding means 39 and through the floor zone 42 of clothing receiving part 33 and fixed, on the other hand, by the four connections 46. As can be seen, the wall thickness of back part 32 in the zone of the connection 46 is slightly thinner or less than than the usual wall thickness, which lies in the range of 1 to 3 mm and preferably is 2 mm. In this way it is prevented that the sharp, rectangular edges 44 lead to fissures or sites of slight fractures. Furthermore, this also enables easier production of connection 46. Thus, a very stable and inexpensive connection arises between head piece 36 and hollow flat rod 31.

As a modification to the connection as described above, the recesses or grooves 43 may also be provided with radiused edges, which is particularly the case during the punching in of insertion part 41. Furthermore, recesses 43 need not necessarily be rectangular, but the same function may also be achieved when they are provided with a round shape. In this case the dies are naturally also provided with a respective round shape, so that the material of wall 42 can be pressed into recesses 39 in a form-fitting manner.

In FIG. 11 the width of clothing receiving part or base part 33 of flat rod 31 is indicated with "a", the height of the flat rod 31 with "h", the minimum width of back part 32 with "b" and the maximum width of back part 32 with "c". By conducting in-depth trials and calculations of the moments of inertia for the predefined installation dimensions and the material properties of the various materials that are employed herein, it has been determined that the ratio between width "a" of the receiving part 3 and the minimum width "b" of the back part should be less than 3:1, and preferably in the range of 2.5:1 to 1.5:1. Moreover, the ratio between the whole height "h" of flat rod 31 and width "a" of the clothing receiving part 33 should be less than 2:1. It has further been determined that, in the present constructional dimensions of the revolving flats, back part 32 may be rectangular over nearly the whole height and it does not necessarily have to be provided with a roof-like tapering part as is set forth in previously-mentioned U.S. Pat. No. 4,827,573 in order to obtain the required bending resistance and twisting resistance. This means tangibly that the ratio between maximum width "c" and minimum width "b" is less than 3:2 and, owing to the deflection of flat rods 31 on their path of movement, should obviously always be more than 1, i.e., a slight minimal "tapering" of the two sides of back part 32 is always provided.

For the construction of the above-mentioned flat rod 31 preferably steel or a light metal, such as aluminum, are used. Flat rod 31, with the profiled shape shown in FIG. 10, is drawn from a steel tube. When aluminum is used, however, it is pressed by means of a suitable profiled mold (so-called extrusion molding). When steel and aluminum are utilized, the flat rods are produced via the so-called cold forming process. These forming processes are well known and are therefore not described any further. It should be understood from the previous description that recesses 39 in the wall of flat rod 31 principally only have to coincide with grooves 43 in insertion part 41 in order to bring about connections 46. Owing to the manufacturing process of drawing or cold pressing it is obviously cost-effective that recesses 39 need not be milled out afterwards, but can be produced at the same time. As can be determined very easily, the stability of the connections 46 is not impaired in any way. The head piece 36 per se is preferably made from cast iron. It may, however, be made from any other stable material. Notice should be taken in this respect, however, that the lower side of head part 40 should be sufficiently hard so as to avoid unnecessary and rapid wear.

Figure 12:
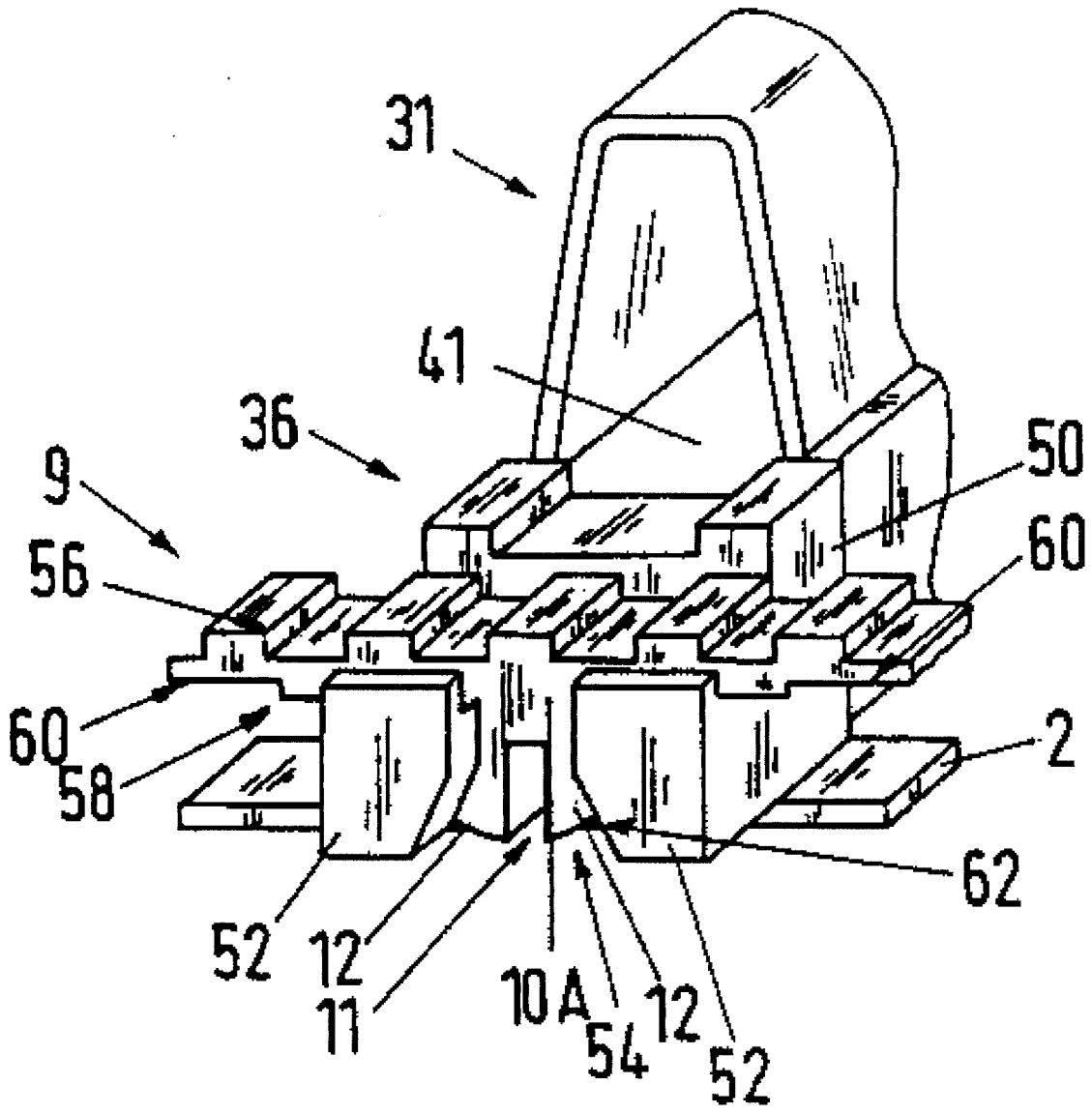
FIG. 12 shows a view similar to that of FIG. 1 in another preferred embodiment thereof.

FIG. 12 shows the preferred embodiment which is based on a combination of the first and second aspects of the invention. A head piece or part 36 again includes an insertion part 41. Head piece 36 is also provided with a slide section 50, which in the working position of the flat rod is guided along flexible bow 2 and during the return movement along a rail (not shown). Slide section 50 is provided with two projections 52 and the two projections 52 jointly form a receiving opening 54. Flat rod 31 is unchanged with respect to the embodiment of FIG. 8. That is why it is only shown partially in FIG. 12 (schematically) and will not be explained further in connection with FIG. 12.

Drive belt 9 is arranged as a toothed belt. The teeth on the "inner surface" 56 of the belt (i.e., on surface 56, which with respect to the revolving closed path is directed inwardly) cooperate with drive wheels (not shown). On the "outer surface" 58 of the belt, which is opposite to flexible bow 2 in the working position of the flat rods, recesses 60 are provided in pairs, whereby recesses 60 each receive a projection 52. Between the recesses 60 of each pair the belt 9 is provided with a projection 10A which is unitary or integral with the belt and represents a connecting element in accordance with the present invention.

Projection 10A is received in receiving opening 54 between projections 52. The projection is provided with a slot 11, by means of which two "legs" are formed, each of which is provided in the base section with a cam 12. Projection 52 are each provided with an inclined surface 62 so as to better receive and hold cam 12. The legs are elastically compressible so as to form a snap-on connection with head part 36 of flat rod 31.

The connection arising between projection 10A and the projections 52 is solid enough, on the one hand, to hold the flat rod on the belt (even when it is no longer guided by bow 2) and to transmit the drive forces and, on the other hand, it is also detachable by an operator without any special tools (manually). As no other additional (loose) elements are necessary, the manufacturing costs can be kept to a minimum and the assembly/disassembly can be carried out efficiently. The material pairing of the slide section of the flat rod/slide guide of the bow can be optimally fitted and the production of the clothing receiving body from the flat rod nevertheless can be made as inexpensively as possible, whereby the rigidity and the weight of this body can be optimally selected.

In accordance with the preferred solution (FIG. 12) the projecting connecting element is provided on the belt and the receiving part on the rod. This is not absolutely necessary (see FIG. 6), but it is preferred, because it has proven to be relatively difficult to provide a continuous bore in the belt, so that a projecting connecting element can extend through the belt without impairing the drive system (not illustrated).

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A connection between a flat rod of a revolving flat card and a flexible drive belt for flat rods, wherein a flexible connecting element is formed as a snap-on connection integrally with the drive belt or with a part of the flat rod, and is received directly in a part of the flat rod or in the belt.

2. The connection of claim 1, in combination with both the drive belt and the flat rod, wherein the drive belt is arranged, on a side opposite of the flat rod, with the flat rod having a flexible projection, the projection being for a frictional engagement, in a clampable manner, with a respective receiving element located at each end of the flat rod.

3. The connection of claim 2, wherein the receiving element consists of two slide bolts, the slide bolts projecting at one end of the flat rod, and the flat rod sliding thereon along a flexible bow of the flat card, with the projection of the drive belt engaging, in a clamping manner, between the two slide bolts.

4. The connection of claim 3, wherein the projection is provided with a slot, the slot extending transversely to the longitudinal direction of the drive belt.

5. The connection of claim 2, wherein the receiving element consists of two slide bolts, the slide bolts projecting at one end of the flat rod and the flat rod sliding thereon along a flexible bow of the flat card, and wherein a slide bolt is clamped on one side by a projection of the drive belt.

6. The connection of claim 2, wherein the receiving element consists of two slide bolts, the slide bolts projecting at one end of the flat rod and the flat rod sliding thereon along a flexible bow of the flat card, and wherein a slide bolt is clamped on either side by one projection each of the drive belt.

7. The connection of claim 1, in combination with both the drive belt and the flat rod wherein an end of the flat rod is cuboid shaped, and wherein a pin, aligned towards the drive belt, is provided with a clamping element at the end that engages in a clamping manner in a respective receiving hole located in the drive belt.

8. The connection of claim 7, wherein the clamping element consists of two laterally arranged leaf springs.

9. The connection of claim 7, wherein the clamping element consists of a least one spring washer.

10. The connection of claim 7, wherein the clamping element consists of a rubber spring.

11. The connection of claim 1, in combination with both the drive belt and the flat rod, wherein an end of the flat rod is cuboid shaped, and wherein a projection is provided on the drive belt, the projection being retained in a clamping manner by a clamping element in a respective receiving hole located in the end of the flat rod.

12. The connection of claim 1, wherein the revolving flat card has a back part and a clothing receiving part, and wherein the flat rod is formed as a hollow profile and includes head pieces attached in the hollow profile at the two ends thereof, wherein the head pieces are provided with at least one recess on either side towards the hollow profile, in which a zone of the wall of the hollow profile, which zone is directly opposite the recess, is pressed inwardly by means of bending deformation for the attachment of the head pieces to the hollow profile.

13. The connection of claim 12, wherein the recess in the head pieces is at least partly rectangularly shaped.

14. The connection of claim 12, wherein a recess or a guiding means is provided on either side in an inner wall of the back part of the flat rod in a longitudinal direction.

15. The connection of claim 14, wherein the recess or the guiding means extends over the whole length of the flat rod.

16. The connection of claim 12, wherein the wall thickness of the wall of the hollow profile in the zone of the head part is thinner than the wall thickness of the wall of the hollow profile in the remaining area thereof.

17. The connection of claim 12, wherein the back part is of a substantially rectangular form and the ratio between a width of the receiving part and a minimum width of the back part is less than 3:1.

18. The connection of claim 17, wherein the ratio is in the range of about 2.5:1 to 1.5:1.

19. The connection of claim 12, wherein the ratio between height of the flat rod and the width of the clothing receiving part is less than 2:1.

20. The connection of claim 12, wherein the ratio between a maximum width and a minimum width of the back part is less than 3:2.

21. The connection of claim 1, wherein the revolving flat card has a back part and a clothing receiving part, and wherein the flat rod is formed as a hollow profile and includes head pieces attached in the hollow profile at the two ends thereof, wherein the back part is of a substantially rectangular form and wherein a ratio between a width of the receiving part and a minimum width of the back part is less than 3:1.

22. The connection of claim 21, wherein the ratio is in the range of about 2.5:1 to 1.5:1.

23. The connection of claim 21, wherein the ratio between height of the flat rod and the width of the clothing receiving part is less than 2:1.

24. The connection of claim 21, wherein the ratio between a maximum width and a minimum width of the back part is less than 3:2.

25. The connection of claim 21, wherein the hollow profile is drawn from a steel tube.

26. The connection of claim 21, wherein the hollow profile is made of extruded aluminum.

27. The connection of claim 1, in combination with both the drive belt and the flat rod, wherein the flat rod is formed as a hollow profile and includes a head piece attached in the hollow profile at ends thereof, wherein said head piece is provided with a slide section which in turn is provided with two depending projections which jointly form a receiving opening, and wherein a flexible projection is provided on the drive belt, the flexible projection including a clamping element, said clamping element being frictionally retained, in a clamping manner, within said receiving opening.

* * * * *